US005417724A

United States Patent [19]

Pacifici et al.

[11] Patent Number: 5,417,724

[45] Date of Patent: * May 23, 1995

[54] METHOD OF TREATING ACID DYED NYLON FIBERS TO ENHANCE COLORFASTNESS

[75] Inventors: Joseph A. Pacifici, 1609 Northlake Dr., Anderson, S.C. 29625; Daniel G. Sims, 222 Sugar Creek Rd., Greer, S.C. 29650

[73] Assignees: Joseph A. Pacifici, Anderson; Daniel G. Sims, Greer, both of S.C. ; a part interest

[ * ] Notice: The portion of the term of this patent subsequent to Aug. 30, 2011 has been disclaimed.

[21] Appl. No.: 62,843

[22] Filed: May 17, 1993

Related U.S. Application Data

[63] Continuation-in-part of Ser. No. 991,327, Dec. 16, 1992, Pat. No. 5,342,417.

[51] Int. Cl.[6] ..... D06P 3/06; C09B 67/00; D06M 101/00

[52] U.S. Cl. ..... 8/554; 8/552; 8/557; 8/560; 8/115.56; 8/115.65; 8/924; 8/673; 8/680; 8/685

[58] Field of Search ..... 8/495, 552, 554, 557, 8/560, 924, 115.56, 115.65, 673, 680, 685

[56] References Cited

U.S. PATENT DOCUMENTS

| | | | |
|---|---|---|---|
| 4,599,087 | 7/1986 | Heller et al. | 8/495 |
| 4,604,101 | 8/1986 | Kissling et al. | 8/551 |
| 4,718,918 | 1/1988 | Heller et al. | 8/495 |
| 4,764,585 | 8/1988 | Heller et al. | 528/233 |
| 4,875,901 | 10/1989 | Payet et al. | 8/115.56 |
| 4,937,123 | 6/1990 | Chang et al. | 428/96 |
| 5,085,667 | 2/1992 | Jenkins | 8/539 |

OTHER PUBLICATIONS

Dyeing wtih Acid Dyes, Dyeing Primer: Part 2, by: J. Lee Rush, Allied Chemical Corp. pp. 7–9 Feb. 1980.

*Primary Examiner*—Christine Skane
*Assistant Examiner*—Margaret Einsmann
*Attorney, Agent, or Firm*—Kennedy & Kennedy

[57] ABSTRACT

The cold water bleed propensity of acid and premetallized acid dyed cationic dyeable nylon fibers is substantially reduced by treating the fibers with both a nylon fixing agent and a cotton fixing agent. Colorfastness of acid and premetallized acid dyed nylon fibers, other than CD nylon fibers, is also enhanced by treating the fibers with both a cotton fixing agent and a nylon fixing agent.

5 Claims, No Drawings

METHOD OF TREATING ACID DYED NYLON FIBERS TO ENHANCE COLORFASTNESS

REFERENCE TO RELATED APPLICATION

This is a continuation-in-part of application Ser. No. 991,327 filed Dec. 16, 1992, now U.S. Pat. No. 5,342,417.

TECHNICAL FIELD

This invention relates generally to methods of treating dyed nylon fibers, and particularly to methods of treating cationic dyeable type nylon fibers that are dyed with acid dyes or premetallized acid dyes in a manner so as to inhibit their propensity to bleed in cold water. This invention also relates to method of enhancing colorfastness of nylon fibers in cold water and under elevated temperature conditions.

BACKGROUND OF THE INVENTION

Natural fibers, such as cotton, wool and silk, and synthetic fibers such as nylon, acrylic and polyester, are used in the textile industry to produce apparel products such as knits and wovens, piled fabrics such as carpets, and consumer goods such as sheets and towels. These products undergo a number of processes to impart certain physical and aesthetic properties to satisfy consumer needs.

One of the major processes used in the production of textiles is that of coloration. In this process dyes are imparted to fibers to produce a myriad of visual effects on finished textile goods. Associated with the use of dyes are dye auxiliaries which aid in the dyeing process or in maintaining quality standards as defined by the end use. One of these standards is cold water bleed as measured by AATCC test method 107. Dyed textile goods display a tendency to transfer dye from fiber to fiber, yarn to yarn, and fabric to fabric when they are in aqueous contact with each other. The degree to which this transfer occurs depends on several factors such as fiber type, dye type and depth of shade. Thus one class of dye auxiliary is that which is employed to minimize or eliminate cold water bleed. These chemical auxiliaries are traditionally called "fixing agents". For example, nylon fixing agents are used to treat nylon textiles dyed with acid dyes while cotton fixing agents are used to treat cellulosic textiles dyed with fiber reactive, direct or vat dyed.

Some nylon carpet fibers are receptive to being dyed with acid dyes while other types of nylon fibers are receptive to being dyed with basic dyes which are referred to as cationic dyes. Basic, cationic dyeable nylon commonly contains $SO_3H$ or COOH groups within their polymer structure in an amount sufficient to render the nylon fiber dyeable with a basic dye. Though cationic dyeable (CD) nylons offer good stain resistant properties, particularly to acid dye type stains, they have suffered from poor lightfastness, especially in light shades. This has greatly limited their commercial utilization.

The just described problem has recently been addressed and partially solved by dyeing CD nylon fibers with acid and premetallized acid dyes as disclosed in U.S. Pat. No. 5,085,667 of William G. Jenkins. Associated with this process, however, is increased cold water bleed to levels below acceptable standards in many shades of color.

Of additional importance in the textile industry is the colorfastness properties of nylon fibers since nylon fibers are of more general use than CD nylon fibers. Colorfastness, i.e., the resistance of a material to changing its color characteristics, is measured by colorfastness to water (commonly referred to as cold water bleed) and colorfastness to laundrying. Cold water bleed problems occur when nylon fibers such as polyamide fibers are dyed with acid or acid premetallized dyes. Generally, nylon fixing agents alone adequately reduce cold water bleed of most acid or premetallized acid dyed nylon. However, when darker shades of dye are used, especially blue shades, cold water bleed remains a problem even when a nylon fixing agent is employed. Further, nylon fibers dyed with acid or acid premetallized dyes have reduced colorfastness to laundrying in the darker shades.

SUMMARY OF THE INVENTION

It has now been discovered that cold water bleed from acid or premetallized acid dyed cationic dyeable nylon can be substantially improved, and in some cases even eliminated, by treatment with both a nylon fixing agent and with a cotton fixing agent. Preferably, a two step process is employed wherein the cotton fixing agent is applied after the nylon fixing agent has been applied. However, both fixing agents may be applied in a single aqueous bath to dyed nylon fibers provided that a compatibilizer is also present to prevent interaction between the two fixing agents themselves.

For nylon fibers having a need for improved colorfastness properties, especially in the darker shades, a two step process is employed in which the dyed fibers are treated with a cotton fixing agent followed by treatment with a nylon fixing agent.

DETAILED DESCRIPTION

Nine treatment baths were made as set forth in Table 1.

TABLE 1

| Chemical | | g/1000 |
|---|---|---|
| | Bath 1 | |
| Simcofix N-201A | | 40 |
| Water | | 960 |
| Sulfamic acid | | adjust pH to 2.5 |
| | Bath 2 | |
| Simco Coupler B | | 40 |
| Water | | 960 |
| | Bath 3 | |
| Simcofix N-201A | | 20 |
| Water | | 980 |
| Sulfamic acid | | adjust pH to 2.5 |
| | Bath 4 | |
| Simcofix Coupler B | | 20 |
| Water | | 980 |
| | Bath 5 | |
| Simcofix N-201A | | 20 |
| HCO-200 (50%) | | 20 |
| Simco Coupler B | | 20 |
| Water | | 940 |
| Sulfamic acid | | adjust pH to 2.5 |
| | Bath 6 | |
| Chemical | | g/200 |
| Simcofix N-201A | | 0.2 |
| Water | | 199.8 |
| pH | | adjusted to 2.5 |
| | Bath 7 | |
| Simco Coupler B | | 0.2 |
| Water | | 199.8 |
| pH | | no adjustment |
| | Bath 8 | |

TABLE 1-continued

| | |
|---|---|
| Simcofix N-201A | 0.5 |
| Water | 199.5 |
| pH | adjusted to 2.5 |
| Bath 9 | |
| Simco Coupler B | 0.5 |
| Water | 199.5 |
| pH | no adjustment |

Experiment I

Three dark shades dyed with premetallized acid dyes, specifically dark blue, black, and dark orange, of knitted yarn sock made from dupont nylon 66 type 494 cationic dyeable nylon yarn were tested. The dark blue sock fibers were dyed with Nylanthrene Blue GLF (15% OWF), the black fibers with Intrachrome Black RPL liq (15% OWF) and the orange with Intralan yellow 2BRL-S (15% OWF). Five 12 inch long strips were cut from each shade to provide single samples. Sample 1 was not treated with any dye fixing agent. Sample 2 was treated in bath 1 that had the Simcofix N-201A, a nylon dye fixing agent produced by Simco Products, Inc. of Greenville, S.C. which is a novalac type polymer primarily used to improve 2A washfasteners and cold water bleed on nylon apparel. Sample 3 was treated in bath 2 having the Simco Coupler B, a cationic polyamine polymer which is used as a cotton dye fixing agent. Sample 4 was treated first in Bath 3 with the Simcofix N-201A and then in Bath 4 with Simco Coupler B in a two step, tandem process. Sample 5 was treated in a one step process in a bath 5 containing the Simcofix N-201A, the Simco Coupler B and HCO-200 (hydrogenated castor oil, 200 moles EO) as a compatibilizer or blocking agent to prevent reaction between the two fixing agents.

All of the samples were submerged in the baths after having first been wet out with water and extracted in a washer. Samples 2 and 3 were emerged from their treatment solutions, squeezed lightly to obtain about 50% differential wet pick up 2% chemical OWF (on weight of fiber), steamed for three minutes, then rinsed in cold water, extracted and dried. Sample 4 was emerged from the Simcofix N-201A solution, squeezed lightly to about 50% differential wet pick up (1% chemical OWF), steamed for three minutes, rinsed in cold water and extracted. It was then submerged in the Simco Coupler B bath, emerged, squeezed to about 50% differential wet pick up (1% chemical and OWF), and steamed for 15 seconds. The sample was then rinsed in cold water, extracted and dried. Finally Sample 5 was submerged in the Simcofix N-201A plus Simco Coupler B plus compatibilizer bath, emerged, squeezed lightly to about 50% differential wet pick up (3% chemical OWF) and steamed for three minutes. It was then rinsed with cold water, extracted and dried.

All of the samples were evaluated for cold water bleed propensity using AATCC Test Method 107 (1978). The following numerical ratings were determined using the AATCC Grey Scale Standard for color difference.

TABLE 2

| Shade | Sample 1 | Sample 2 | Sample 3 | Sample 4 | Sample 5 |
|---|---|---|---|---|---|
| Blue | 1 | 3 | 2 | 4–5 | 3–4 |
| Black | 2 | 4 | 3 | 5 | 4 |
| Orange | 1–2 | 3–4 | 3 | 4–5 | 4 |

*The ratings given are visual ratings using the AATCC Grey Scale Standard against an untreated, undyed control. A rating of 1 = severe Cold Water Bleed, 5 = no Cold Water Bleed.

Experiment II

This experiment was done in the same manner as Experiment I with the following exceptions:

a. Only the blue shade was used.

b. Neofix R-250 from Nicca USA, Inc., Fountain Inn, SC was used in place of Simco Coupler B. Neofix R-250 is a cationic polyamide type polymer used as a cotton fixing agent.

c. Samples 3 and 5 were deleted.

The following numerical ratings were again determined using the same AATCC test method as before.

TABLE 3

| Shade | Sample 1 | Sample 2 | Sample 4 |
|---|---|---|---|
| Blue | 1–2 | 3–4 | 5 |

Why the cotton fixing agent is so effective here is not understood. Its effectiveness is quite unexpected since cotton fixing agents are large cationic polymers, usually polyamine or polyamides, that react with the anionic dyes used on cotton fibers to form complex salts with low solubility in water. This serves to prevent the dyes from desorbing from the cotton fibers and transferring back into an aqueous media or onto other cotton fibers, i.e. from cold water bleeding. It is speculated that the cotton fixing agent is coupling the CD nylon fibers to the nylon fixing agent due to the affinity of the cationic cotton fixing agent to the anionic fibers and anionic nylon fixing agent. Since the nylon fixing agent is holding the dyes to each other by a polymer network, the cotton fixing agent apparently is, in essence, holding the dyes to the fiber through this coupling mechanism. Though there is no proof of this yet, it is at least a theoretically plausible explanation.

Experiment III

This experiment addressed colorfastness as to cold water bleed in acid or premetallized acid dyed polyamide fibers, specifically in darker shades, namely the blue shades. Three knitted yarn sock samples made from DuPont nylon 66 were dyed with Nylanthrene GLF, with two of the dyed socks fixed by a batch method. Sample 6 was not treated with any dye fixing agent. Sample 7 was treated first in bath 6 with the nylon fixing agent Simcofix N-201 A and then in bath 7 with the cotton fixing agent Simco Coupler B. Sample 8 was treated first with the cotton fixing agent in bath 7 followed by the nylon fixing agent in bath 6.

The procedure for sample 7 was to submerge the dyed knitted sock in bath 6, heat the treatment bath with the sample to 150° F., and agitate for 20 minutes. The sample was removed and rinsed with the excess water extracted. Then the damp sample was submerged in bath 7, heated in the bath to 150° F., and agitated for 20 minutes. Following removal and rinsing, water was extracted and the sample was dried. The procedure for sample 8 followed the same steps as sample 7 except that treatment was in bath 7 first followed by treatment in bath 6.

The following numerical ratings were determined using the AATCC Test Method 107 (1978) also employed in experiments I and II.

TABLE 4

| Shade | Sample 6 | Sample 7 | Sample 8 |
|---|---|---|---|
| Blue | 1–2 | 3 | 5 |

The effectiveness of using the cotton fixing agent followed by the nylon fixing agent with blue GLF dye on nylon in sample 8 shows a significant improvement far above that previously expected. Historically, a rating of three (3) has been the highest achieved by using only nylon fixing agents. Sample 7 shows an improvement over the control sample 6, however this is no better than results obtained using conventional nylon fixing agents. The unusual result obtained by Sample 8 may be explained assuming that the cotton fixing agent has an affinity for the anionic acid dyes thus complexing them. When the samples are treated with a nylon fixing agent first, the strong anionic nature of the nylon fixing agent interferes with the complexing process of the cotton fixing agent. However, by treating first with the cotton fixing agent, the acid dyes are believed to be complexed, thus having a cationic nature. The anionic nylon fixing agents now have the ability to couple the cationic fiber to the cationic complexed dyes.

Experiment IV

This experiment addressed colorfastness properties in nylon fibers as to laundrying at elevated temperatures. Multicolored (space dyed) DuPont nylon type 66 carpet yarn was dyed in a random pattern with dark shades using leveling type acid dyes, predominately in dark brown, dark green, and black. Three ten gram dyed samples of yarn were prepared together with three undyed nylon swatches of three grams each. Sample 9 was not treated with a fixing agent. Sample 10 was treated in bath 8 with the nylon fixing agent only. Sample 11 was treated first in bath 9 with the cotton fixing agent then in bath 8 with the nylon fixing agent.

The treatment procedure for sample 10 was to submerge the dyed yarn in bath 8, heat to 150° F., and agitate for 20 minutes. Sample 10 was then removed from the bath, rinsed, and extracted. Sample 11 was submerged in bath 9, heated to 150° F., agitated for 20 minutes, removed, rinsed, extracted, and transferred to bath 8. Once submerged in bath 8, sample 11 was heated to 150° F., agitated for 20 minutes, removed, rinsed, and extracted.

Under a modification of AATCC Test Method 61-1989, test no. 4A, samples 9, 10, and 11 were placed in three separate containers together with a three gram undyed nylon swatch and 300 ml of water at pH 5. The containers were heated to 95° C. for one hour with occasional agitation to insure even color transfer from the dyed yarn to the undyed swatch. The swatches were removed, dried, and evaluated for color transfer under hot water conditions using the AATCC grey color standard for staining. The results were as follows in Table 5.

TABLE 5

| | Sample 9 | Sample 10 | Sample 11 |
|---|---|---|---|
| Grey scale rating | 2 | 2 | 4 |

The resulting data shows that the new process substantially improves colorfastness by significantly reducing the amount of dye transfer to the undyed swatches under elevated temperature conditions over the control and the nylon fixing agent treated only samples. Indeed, the sample treated with nylon fixing agent alone has no apparent improvement in colorfastness, but under less severe temperature conditions this sample would be expected to have improved colorfastness over the untreated control sample.

It thus is seen that a method is now provided for treating CD nylon fibers and nylon fibers dyed with acid or premetallized acid dye to inhibit their propensity for bleeding in cold water and to improve colorfastness. It should of course be understood that the specific examples described only illustrate practices of the invention in its preferred form. Many modifications, deletions, and additions may be employed without departure from the spirit and scope of the invention as set forth in the following claims.

We claim:

1. The method of enhancing colorfastness of acid and premetallized acid dyed nylon fibers wherein the fibers are treated with a cotton fixing agent and subsequently with a nylon fixing agent.

2. The method of claim 1 wherein the wherein the nylon fibers are treated with a cotton fixing agent selected from the group consisting of polyamine polymers and polyamide polymers.

3. A method of enhancing colorfastness of acid and premetallized acid dyed nylon fibers wherein the fibers are treated with an cationic dye fixing agent and subsequently with a anionic dye fixing agent.

4. A method of dyeing nylon fibers wherein the fibers are dyed with an acid or premetallized acid dye and then treated with an cationic dye fixing agent and subsequently with a anionic dye fixing agent.

5. A method of dyeing nylon fibers wherein the fibers are dyed with an acid or premetallized acid dye and then treated with a cotton fixing agent and subsequently with a nylon fixing agent.

* * * * *